United States Patent [19]

Ingham

[11] 4,083,390

[45] Apr. 11, 1978

[54] GROOVING OF SHEET MATERIAL

[75] Inventor: Robert Edward Ingham, Knaresborough, England

[73] Assignee: R.E. Ingham & Co., Limited, England

[21] Appl. No.: 634,372

[22] Filed: Nov. 24, 1975

Related U.S. Application Data

[63] Continuation-in-part of Ser. No. 469,951, May 15, 1974, abandoned.

[51] Int. Cl.[2] ..... B27C 5/00

[52] U.S. Cl. ..... 144/136 R; 83/1; 83/5; 144/155; 144/158; 144/323

[58] Field of Search ..... 83/1, 5, 917; 30/121, 30/278, 280; 144/1 R, 2 R, 3 R, 42, 43, 44, 134 R, 134 B, 136 R, 134 H, 155, 158, 159, 161, 309 L, 321, 322, 323, 326 R

[56] References Cited

U.S. PATENT DOCUMENTS

| | | | |
|---|---|---|---|
| 865,833 | 9/1907 | Walton | 30/121 |
| 882,978 | 3/1908 | Temps | 144/155 |
| 2,596,365 | 5/1952 | Bresnahan | 144/136 R X |
| 2,870,806 | 1/1959 | Thompson | 144/136 R |

FOREIGN PATENT DOCUMENTS

| | | | |
|---|---|---|---|
| 73,049 | 5/1932 | France | 144/136 R |

*Primary Examiner*—Othell M. Simpson
*Assistant Examiner*—W. D. Bray
*Attorney, Agent, or Firm*—Wolf, Greenfield & Sacks

[57] ABSTRACT

A machine for cutting grooves in workpieces, particularly in sheet form, having at least one fixed cutter, support means for supporting the workpiece against the cutter and means for moving the workpiece relative to the cutter and support means. The cutter has a cutting edge defining the shape of groove to be cut and is arranged to slice through the workpiece to produce a groove leaving a constant thickness of material between the bottom of the groove and the other side of the workpiece. The forces tending to lift the workpiece from its support due to the action on the cutter of material removed thereby are overcome and a resultant force operating to press the workpiece on to its support is produced by arranging, either singly or in combination, that a. the cutter has a cutting edge substantially contained in a plane which extends forwardly in the direction of relative movement of the cutter and upwardly of the surface of the workpiece, b. the cutter has a bevel face which faces the workpiece and extend rearwardly from the cutting edge at a negative angle of clearance to the workpiece.

10 Claims, 19 Drawing Figures

16
30
32
34
28
3°
56
50
52
49
48
54

GROOVING OF SHEET MATERIAL

This application is a continuation in part of application Ser. No. 469951 filed on May 15th, 1974, and which is now abandoned. BACKGROUND OF THE INVENTION This invention is concerned with the machining of timber and timber substitute workpieces, and particularly to machines for performing the machining operations. The invention has a special application in the machining of timber substitute sheet material such as hardboard, chipboard, fibre board, paperboard and the like and particularly to the machining of grooves in such material.

One type of groove that is frequently required to be machined is a V shaped groove since by forming sheet material with such grooves at suitable locations the material may be folded about the line of each groove to form a three dimensional article. The technique involved in carrying out this known process is to cut the V groove in such a manner that its point penetrates almost, but not quite, completely through the sheet material and so as to leave a thin membrane of material connecting the sheet material on opposite sides of the groove. When the sheet material is folded to bring the opposed faces of the groove together, with or without an intervening layer of adhesive, this membrane acts as a hinge. A form of sheet material which is very suitable, although not essential, for use in this process is a timber substitute having an adhered outer skin of a tough plastics material such as a P.V.C. In this case the V groove would be cut through all the material except for the plastics skin which remains to act as the connecting membrane. A similar result may be achieved in the case of sheet material having a wood veneer which will be exposed in the finished article if this veneer is covered in the region of the desired groove by an adhesive plastics tape and the V groove is cut through all the sheet material but not through the tape. After folding and glueing this tape may be removed.

DISCUSSION OF THE PRIOR ART

It is important to appreciate that when machining a V groove which is to be used in a subsequent folding operation it is essential to maintain constant the thickness of the connecting membrane which forms the hinge. However most timber substitute materials as manufactured in sheet form have a large thickness tolerance and variations in thickness of 10 % commonly occur. It is for this reason that prior art arrangements which attempt to cut a V groove of constant depth always fail since owing to variation in thickness of the workpiece such a groove may penetrate right through the workpiece at one place and at another place may leave a connecting membrane which is too thick for satisfactory folding. In both cases the appearance of the workpiece after folding will be unacceptable.

Various types of hand held tools for cutting grooves in timber or timber substitutes are known. Such tools which are developments of the normal wood working plane have cutters which may be profiled to produce a groove of the required section. Since the cutter tends to dig into the workpiece it is fixed relative to a sole plate which, as in a normal plane, rides on the surface of the workpiece with the result that the tool is only capable of producing grooves of constant depth which as explained above is not what is required if the workpiece is to be folded about the groove so made. A further defect of this type of tool is that in the case of a profiled cutter the plane containing the cutting edge is inclined forwardly in the direction of movement of the tool and downwardly towards the workpiece. Because of this such tools can only be used to make a thin cut since any attempt to take a deep cut will result in material being torn out of the workpiece.

A different form of hand tool has been proposed for making V grooves in composition board. Such tool has two knife blades which are fixed relative to and protrude through a sole plate. The blades which are mounted at appropriate angles with one somewhat in advance of the other, are intended each to cut a slit, the two slits defining the desired V groove. If the arrangement worked it also would produce a groove of constant depth. In practice however it is unworkable since the relatively thin blades, which have to be bevelled to produce a cutting edge, inevitably deflect from the desired path and sooner or later the tool will either become bound in the workpiece or will ride out of it.

Attempts to apply the principle of these hand tools to machine tools in which the cutter is fixed and the workpiece is moved by power means lead to the same difficulties and disadvantages.

One form of machine tool which has been used to machine V grooves in workpieces which are subsequently folded about the grooves is an adaption of a milling machine such as is used in metal working. Here a rotatable circular cutter is mounted in fixed position relative to a support surface over which a workpiece is moved. The cutter has a plurality of circumferentially spaced teeth each having the required V profile and is rotated at relatively high speed so that the teeth penetrate the workpiece one after the other and gouge chips therefrom to form the groove.

While such a machine is basically suitable for producing a V groove in which the distance between the base of the groove and the other side of the workpiece, i.e. the thickness of the connecting membrane, is constant it has a number of disadvantages in use which make it undesirable. Among these are that, the rotary cutter being mounted directly on the spindle of an electric motor, the cutter unit is heavy and therefore diffucult to mount rigidly and yet provide the necessary accurate control of the position of the cutter both heightwise and widthwise of the workpiece; that owing to the cyclic impacting of the cutter teeth on the workpice this workpiece tends to bounce during cutting, the effect being accentuated by any lack of rigidity in the mounting of the cutter unit or in the support for the workpiece, with the result that the thickness of the connecting membrane at the bottom of the groove varies; that owing to the high speed of the cutting teeth through the workpiece the teeth rapidly becomes blunt with the result that the time taken in resharpening the cutter and setting it up again is a substantial proportion of the operating time; that the linear speed of cutting the groove is low; and that the noise of operation is such that operatives have to wear ear protectors.

OBJECTS OF THE INVENTION

It is a primary object of the invention to provide a machine which avoids the difficulties experienced in using prior art machines and is simple and efficient in operation.

Another object of this invention is to provide a machine which does not require the use of rotating cutters and thereby avoids the difficulties occasioned by the use of such cutters.

A further object of this invention is to provide an arrangement whereby the forces acting on a workpiece during the machining of a groove are balanced such that when machining a V groove the thickness of a connecting membrane left at the bottom of the groove will be substantially constant.

SUMMARY OF THE INVENTION

The improved machine of this invention comprises at least one cutter which has a cutting edge shaped to define the cross section of a groove to be cut in a workpiece. This cutter is fixed and is mounted at a predetermined distance from a support over which the workpiece to be grooved is passed, and the cutter is arranged so as to slice or scoop out material from the workpiece preferably so as to form the desired groove in one pass.

During such operation the material removed produces a reaction between the workpiece and the cutter which tends to lift the workpiece towards the cutter so that it digs in. This difficulty could be reduced if a spring or shoe were used to hold the workpiece down on its support but, apart from the additional complication of the machine and a restriction on the free movement of the workpiece past the cutter, there would still be a tendency for the cutter to tear at the workpiece and leave a ragged cut.

The applicant has found that these difficulties may be removed if the geometry of the cutter and the attitude of the cutter to the surface of a workpiece are suitably controlled.

Consider a cutter having a cutting edge which is contoured to produce a desired shape of groove. The contour of such cutting edge could be continuously curved, made up of two or more joined straight portions or a combination of straight and curved portions. In each case however it is arranged that the cutting edge or edges lie substantially in one plane and the shape of the cutter and its attitude in relation to the workpiece is such that this plane is inclined at an angle of less than 90° forwardly in the direction of movement of the cutter through the workpiece and upwardly away from the surface of the workpiece. When so arranged the movement of the cutter through the workpiece will produce a force which acts to hold the workpiece down on its support. By suitably controlling the geometry of the cutter and its attitude this force may be arranged to be somewhat in excess of the force tending to lift the workpiece, which is created by the action on the cutter of the material which is being removed. In this manner a resultant force may be produced which acts to hold the workpiece against its support and thus prevents the cutter from digging in.

An additional advantage of this configuration is that the cutting edge acts firstly on the outer edges of the groove being cut and progressively towards the bottom of the groove. This ensures a clean cut and prevents material being torn out of the workpiece. By this action of first cutting the material free before attempting to lift it not only is the cut clean but the operation is also more effective and driving forces are reduced.

Alternatively or in addition the cutter may be formed with a short bevel which extends rearwardly from the cutting edge and faces the workpiece. By control of the angle of this bevel on the cutter and the attitude of the cutter it may be arranged that this bevel has a small negative clearance angle, that is to say the rearward edge of this bevel lies closer to the workpiece than the actual cutting edge. Even a quite short bevel of 1mm or less and a negative clearance angle of about 1° is sufficient to create a resultant force which urges the workpiece towards its support. The advantage of using a bevel is not confined to its action in holding the workpiece down on its support. Since a cutting edge tends to slice material along a line bisecting the angle between the two faces of the cutter immediately forming the cutting edge the provision of this bevel at a negative clearance angle will be effective to bring the natural slicing direction more nearly into line with the direction of movement of the cutter relative to the workpiece.

From the foregoing it will be appreciated that the force which tends to lift the workpiece from its support can be overcome either by providing the described forward inclination of the plane containing the cutting edge of the cutter, or by providing the described bevel having a negative clearance angle, or by using a combination of these features. This last mentioned feature of the invention greatly facilitates the design of the cutter for machining different types of material and different shapes of grooves.

DESCRIPTION OF SPECIFIC EMBODIMENTS

Figure 1:
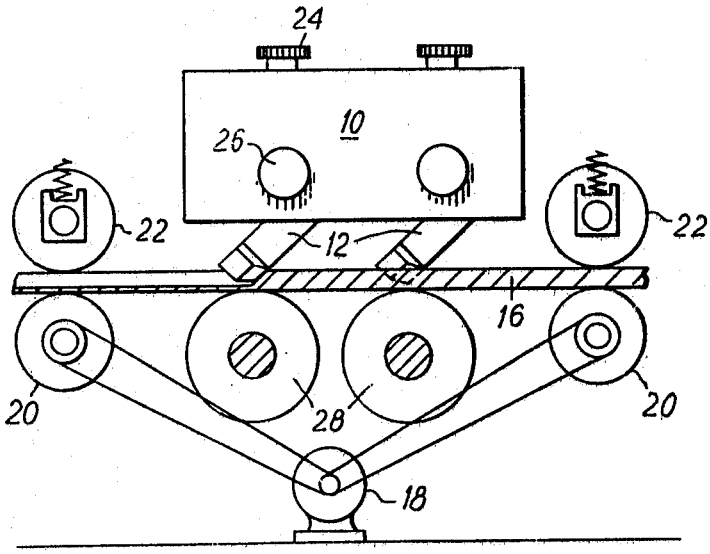
FIG. 1 is a diagrammatic side elevation of a machine according to the invention and adapted for machining V grooves.
Figure 2:
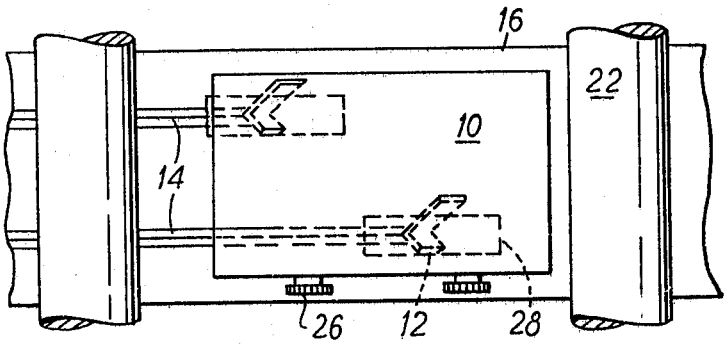
FIG. 2 is a diagrammatic plan view of the machine of FIG. 1.

FIGS. 1 and 2 illustrate diagrammatically a machine according to the invention. This machine comprises a fixed head 10 rigidly mounting (in this example) two cutters 12, each designed for cutting a V groove 14 in a workpiece 16. The machine includes power means for driving the workpiece 16, to the left in FIGS. 1 and 2, and as illustrated such means comprise an electric motor and gear box 18 arranged to rotate drive rollers 20 by belt and pulley means. The workpiece 16 is held against the drive rollers 20 by freely rotatable spring pressed rollers 22. In practice more than two such pairs of rollers 20, 22 will be provided and the machine will include means, not shown, for controlling the lateral position of the workpiece.

The cutters 12 are mounted in the head 10 so that they can be adjusted both heightwise and widthwise of the workpiece and for effecting such adjustment control means, illustrated as knobs 24 and 26, may be provided.

The workpiece 16 is located relative to each cutter 12 by a support which as illustrated comprises a roller 28 mounted for free rotation about an axis which is fixed relative to the head 10 so that the distance of the cutter 12 from the support surface of roller 28 determines the depth of cut in the workpiece 16. It may be observed here that for reasons to be explained below the machine does not have, and does not need to have, any means such as a spring pressed pad for holding the workpiece down on the support surface of roller 28.

Figure 3:
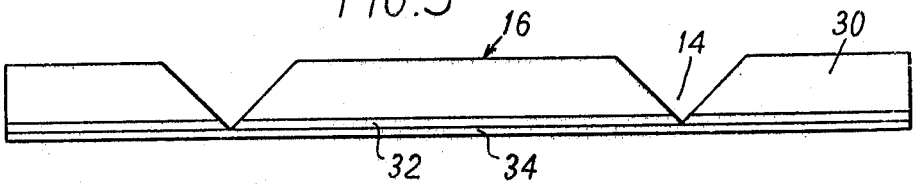
FIG. 3 is an end elevation, to an enlarged scale, of a workpiece after machining by the machine of FIGS. 1 and 2.

FIG. 3 shows an end view of a workpiece after it has been grooved by the machine of FIGS. 1 and 2. For the purpose of illustration this workpiece is shown as a laminate comprising a layer 30 of hardboard, a layer 32 which might consist of a pattern, for example, simulating a wood grain, or an actual wood veneer, and a layer 34 of a transparent tough plastics such as a suitable grade of p.v.c. It will be seen that the groove 14 extends through the layers 30 and 32 but not through the layer 34. There is thus left a membrane which connects the parts of the workpiece on either side of the groove and this membrane acts as a hinge if the workpiece is folded about the line of the groove. It is an important feature of the machine of this invention that the thickness of this membrane, that is the distance between the bottom of the groove and the underside of the workpiece, will be constant even if the thickness of the workpiece varies.

Figure 4:
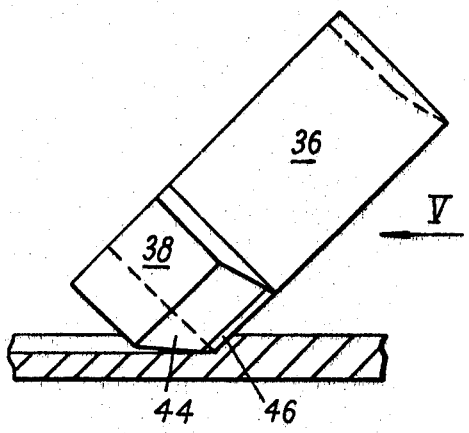
FIG. 4 is a side elevation, to an enlarged scale, of one of the two cutters of the machine of FIGS. 1 and 2.
Figure 5:
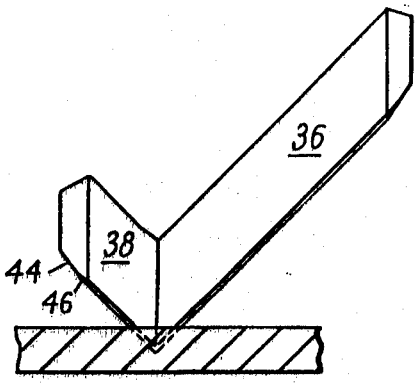
FIG. 5 is an end view of the cutter of FIG. 4 looking in the direction of the Arrow V.

FIGS. 4 and 5 show on a larger scale the cutter 12 of FIGS. 1 and 2. This cutter comprises basically a V shaped component having an arm 36 which is longer than the other arm 38. The longer arm 36 is suitably secured in a holder mounted in the head 10 of the machine.

Figure 6:
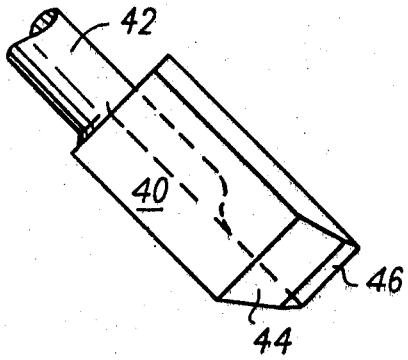
FIGS. 6 and 7 are respectively a side elevation and a front elevation of an alternative form of cutter which is shown in the position it takes during use.
Figure 7:
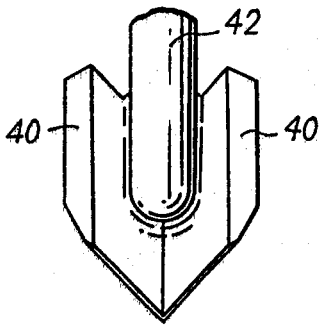

FIGS. 6 and 7 show an alternative form of the cutter which comprises a V shaped component having equal arms 40 which are secured to a rod 42 that fits into a suitable holder in the machine head 10. Apart from the fact that the cutter of FIGS. 4 and 5 might be considered as being pulled through the workpiece whereas the cutter of FIGS 6 and 7 is pushed therethrough these two cutters are in effect identical.

The cutter arms may be formed of separate pieces of metal which are welded or brazed together or the cutter may be formed from solid metal, and in either case the cutting edge may be formed in known manner by an insert of hard metal.

It will be seen that the cutting edges of the two arms of the cutter lie in a common plane which when the cutter is in its operative position as seen in the side elevations, FIGS. 4 and 6, extend forwardly in the direction of movement of the cutter relative to the workpiece and upwardly from the surface of the workpiece. If the angle of inclination of this plane is 45° and the angle contained between the cutting edges of the cutter is 71° an approximately 90° V groove will be produced in the workpiece. The same result may be obtained by using a different combination of angles, and equally grooves of other sectons can be obtained by an appropriate selection of these angles.

The forward inclination of the plane containing the cutter edges operates to produce a force which acts to press the workpiece down onto the support surface of the roller 28 (FIG. 1) and counteracts the force which tends to lift the workpiece which is due to the reaction between the cutter and the material removed thereby. By selecting a suitable inclination of this plane it may be arranged that the force acting to press the workpiece onto its support is somewhat greater than the force tending to lift the workpiece.

When grooves of other shapes are to be machined and the cutting edge of the cutter is curve, or partly curved and partly straight, the same result is obtained if the cutting edge is arranged to be generally in a mean plane which is inclined as above described.

It will be seen from FIGS. 4 to 7 that the cutter arms are sharpened in a manner somewhat similar to that used in the case of a hand held plane in that they have two bevels 44 and 46 which correspond to the ground and honed bevels of a plane iron. The bevel 44 is required only to provide clearance between the cutter and the workpiece and is otherwise not significant. The bevel 46 if arranged in a manner different to that of the honed bevel of a plane iron provides an alternative or additional means for obtaining the required forces acting to press the workpiece towards its support.

Figure 8:
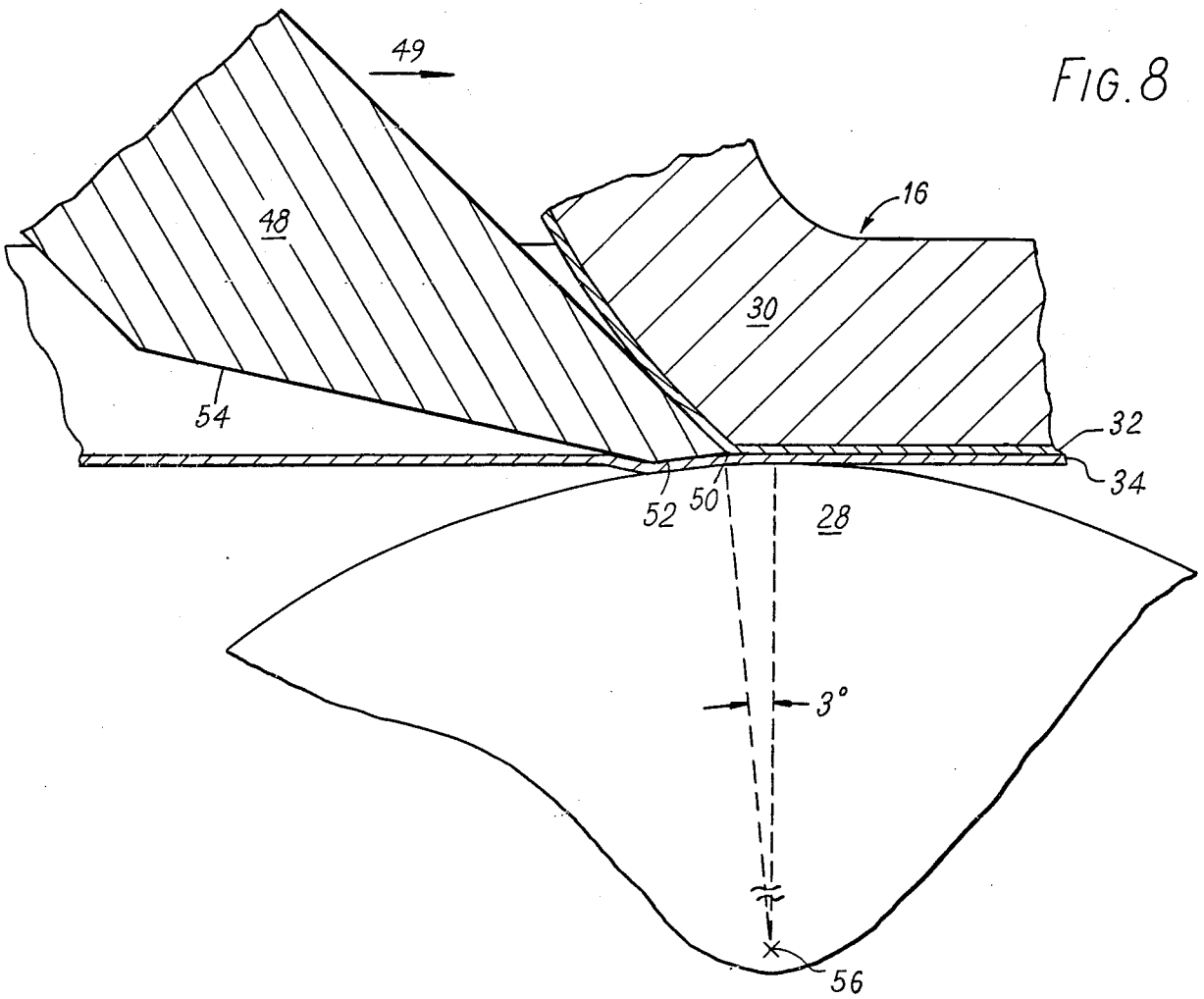
FIG. 8 is a fragmentary central vertical section, to an enlarged scale, taken through the cutter of FIGS. 4 and 5, or the cutter of FIGS. 6 and 7, for the purpose of explanation.

To obtain this result the bevel 46 is formed at such angle on the cutter and the cutter is so orientated to the workpiece that the edge of the bevel remote from the cutting edge les nearer the lower surface of the workpiece than the actual cutting edge. In other words the bevel has a negative clearance angle. The arrangement is illustrated diagrammatically to a larger scale in FIG. 8. Here a cutter 48 moving in the directin of arrow 49 is shown as operating on the workpiece of FIG. 3. The cutting edge 50 is shown as penetrating down to the junction between the layers 32 and 34 whereas the bevel 52 is inclined downwardly and rearwardly from the cutting edge 50 to present a negative angle of clearance to the workpiece. It will be observed that the layer 34 is shown as being deflected by the bevel 52. At the side of the groove being cut the bevel will merely compress the material and this would also occur at the bottom of the groove if the material remaining were thicker. In the special case illustrated and in order to avoid damaging the layer 34 it is convenient to arrange the rotational axis 56 of the support roller 28 somewhat in advance of the cutting tip 50 such that a tangent to the surface of the roller immediately below the cutting tip extends at an angle of about 3° to the underside of the workpiece 16. In this way sufficient clearance is provided to accommodate temporary displacement of the layer 34 by the bevel 52.

If the length of the bevel 52 is of the order of 1mm and the negative angle of clearance is of the order of 1° a strong force tending to press the workpiece down on to the surface of the support roller is produced. This force by itself may be arranged to be sufficient to provide the desired force acting to press the workpiece towards its support, in which case there is no necessity for the described forward inclination of the plane containing the cutting edges of the cutter. Alternatively by a suitable selection of angles and the size of the bevel the forces produced by the forward inclination of the cutting edge and by the bevel may be adjusted so that they counterbalance or somewhat exceed the force tending to lift the workpiece which is produced by the reaction on the cutter of the material removed thereby.

The foregoing is equally true both for the cutters shown in FIGS. 4 to 7 and for cutters designed to produce different shapes of groove and having curved cutting edges. It will however be appreciated that as regards the cutters of FIGS. 4 to 7 the relevant bevels 46 operate on the sides of the V groove but necessarily provide a resultant force acting to hold the workpiece down.

The essential part of the cutter concerns only the geometry of the cutting edge, the surfaces adjacent thereto, and the attitude taken by these parts in relation to the workpiece, the form of the remainder of the cutter being dictated only by mechanical requirements.

Figure 9A:
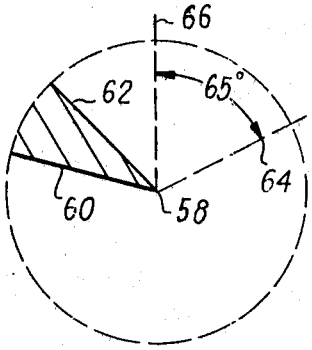
FIG. 9*a* and 9*b* are fragmentary central vertical sections showing different forms of the cutting edge of a cutter.
Figure 9B:
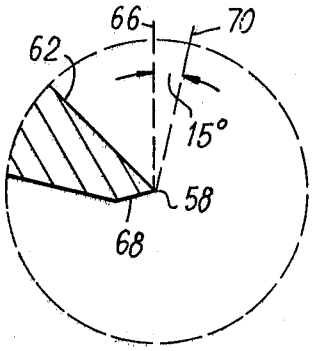

FIGS. 9*a* and 9*b* illustrate by way of example alternative forms which the edge of a cutter may take. In FIG. 9 *a* the cutting edge 58 is shown as being defined by the intersection of two surfaces 60 and 62 while the plane 64 containing the cutting edges of the whole cutter is shown as being inclined forwardly of the normal 66 to the face of a workpiece at an angle of about 65° in order to produce the desired force acting to press the workpiece on to its support. In FIG. 9*b* the cutting edge 58 is shown as being defined by the intersection of two surfaces 62 and 68, the surface 68 presenting a negative angle of clearance to the face of a workpiece. Here the plane 70 containing the cutting edges of the whole cutter is shown as being inclined forwardly of the normal 66 at an angle of only 15°. However the reduction of the force created by the use of a smaller forward inclination is made up by the force created by the negative angle of clearance of surface 68. These figures are only illustrative of the design possibilities and many different configurations may be used, depending on the nature of the material being cut and the desired shape of groove, all of which produce the required resultant force acting to hold the workpiece on its support.

Figure 10A:
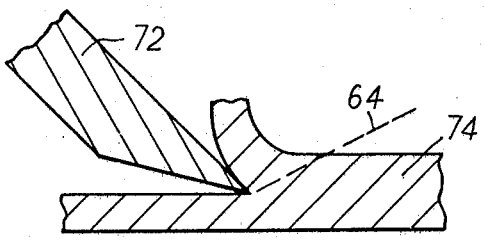
FIGS 10*a* and 10*b*, and FIGS. 11*a* and 11*b* are corresponding sections showing different arrangements of a cutter having the cutting edge of FIGS. 9*a* and 9*b* respectively.
Figure 10B:
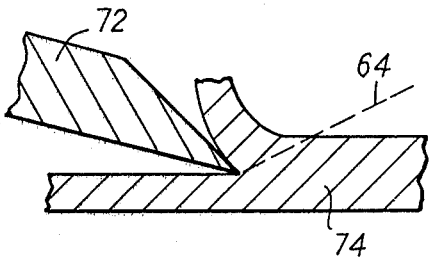
Figure 11A:
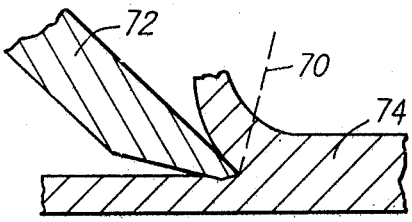
Figure 11B:
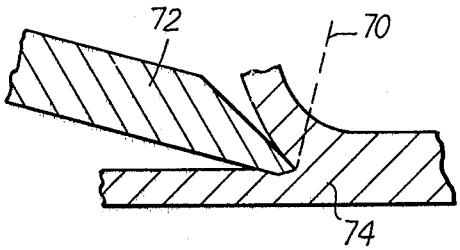

The form which the cutter takes behind the cutting edge is unimportant and alternative possibilities are illustrated in FIG. 10*a* and 10*a* as regards the cutting edge of FIG. 9*a* and in FIGS. 11*a* and 11*b* as regards the cutting edge of FIG. 9*b*. FIGS. 10*a* and 10*b* and 11*a* and 11*b* all show in cross section a cutter 72 operating on a workpiece 74.

In the machine illustrated in FIGS. 1 and 2 the cutters 12 are arranged to slice grooves in the top of the material 16. The whole arrangement can be inverted whereby the cutters slice the grooves in the underside of the material. Such inverted arrangement has the advantage that chip removal is simplified. It is equally possible to arrange that the machine operates to slice grooves simultaneously in the top underside of the material.

Although the machine of FIGS. 1 and 2 shows the use of a roller to support a workpiece against a cutter this is not essential and other forms of support means may be used such as a table or a localised pad.

Figure 12A:
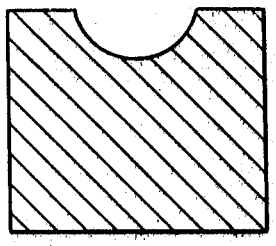
FIGS. 12*a* to 12*e* illustrate different forms of groove which may be machined by a machine according to the invention.
Figure 12B:
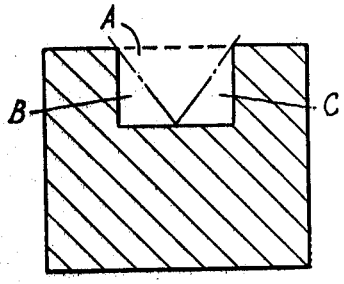
Figure 12C:
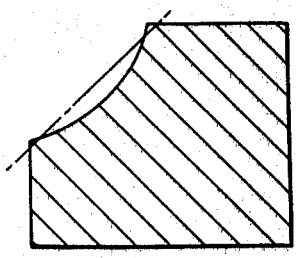
Figure 12D:
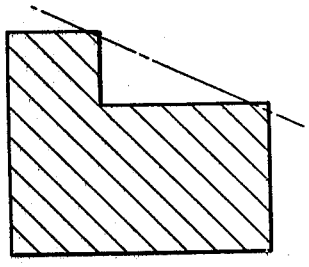
Figure 12E:
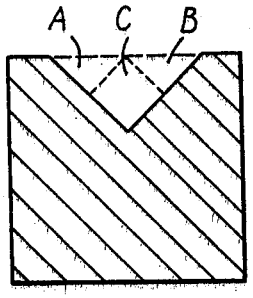

It is to be understood that the machine of the invention is not restricted to the machining of V grooves. Other groove shapes can be produced by appropriate design of the cutter. FIGS. 12*a* to 12*d* show other groove forms that may be produced. In FIG. 12*a*, a curved cutter serves to form a groove of arcuate cross section; in FIG. 12*b*, a square groove is formed by means of three cutters arranged in the machine head one behind the other, the cutters being each of the form illustrated in FIGS. 4 to 7, the first cutter making a vee-groove A in the workpiece and the subsequent cutters removing portions B and C; in FIG. 12*c*, a curved cutter is used to form a concave groove at a corner of a workpiece; and in FIG. 12*d* a right angled groove is formed in the workpiece by means of a single cutter which may be as illustrated in FIGS. 4 to 7 but orientated at a different angle. FIG. 12*e* illustrates the formation of a V groove by the use of three cutters arranged one behind the other in the machine head, these cutters removing in succession the portions A, B and C. Normally such a groove may be cut by a single cutter the whole of the material of the groove being removed as a single continuous chip. In some materials it may however be desirable to follow up with a second cutter set slightly deeper so as to effect a finishing cut.

Apart from the above described advantages of the machine of this invention it has many advantages over the above described prior art grooving machine using a rotary cutter among which are that it is almost silent in operation and that it operates at a much higher linear speed. In addition the cutters are much simpler to sharpen and will provide a much greater throughput before sharpening is required.

I claim:

1. In a groove cutting machine of the type having
groove cutter means for cutting a groove in a workpiece
means for holding the cutter means,
3. support means for supporting a workpiece against the cutter means during the cutting of a groove in the workpiece by the cutter means, and,
4. drive means for causing relative motion between the workpiece and the cutter means to effect the cutting of a groove in the workpiece by the cutter means, the improvement for cutting a groove in one face of the workpiece whereby a constant thickness of material remains between the bottom of the groove and the other face of the workpiece wherein i. the cutter means comprises at least one cutter whose cutting edged are located in a common plane, the shape of those cutting edges in that common plane defining the cross-section of the groove to be cut
ii. the means for holding the cutter keeps the common plane of those cutting edges in a substantially constant angular position relative to the workpiece the common plane being inclined fowardly in the direction of movement of the cutter relative to the workpiece and that common plane extends upwardly from the bottom of the groove made by the cutting edges.

2. The improvement according to claim 1 wherein the cutter has two straight arms connected to form a Vee, each of the straight arms having a cutting edge extending to the apex of the Vee.

3. The improvement according to claim 1 wherein the cutter and support means are stationary and the drive means is adapted to move the workpiece past the cutter means.

4. In a groove cutting machine of the type having
1. cutter means,
2. support means for supporting a workpiece during the cutting of a groove in the workpiece by the cutter means,
3. drive means for causing relative motion between the workpiece and the cutter means to effect the cutting of a groove in the workpiece by the cutter means. the improvement for cutting a groove in one face of the workpiece whereby a constant thickness of material remains between the bottom of the groove and the other face of the workpiece wherein the cutter means comprises at least one cutter having a cutting edge defining the cross section of the groove to be cut and means for holding the cutter in position to cut through the workpiece during said relative motion, said cutter being formed with a bevel face which extends rearwardly from the cutting edge and faces the workpiece, the cutter being positioned such that the bevel face has a negative angle of clearance with respect to the workpiece.

5. The improvement according to claim 4 wherein the negative angle of clearance is of the order of 1°.

6. The improvement according to claim 4 wherein the support means comprises a roller which is freely rotatable about a fixed axis, the said axis being positioned such that the workpiece is supported at that part which is engaged by the cutter.

7. The improvement according to claim 4 wherein the cutting means consist of at least two cutters each positioned to cut its own groove in the workpiece.

8. The improvement according to claim 7 wherein the cutters are arranged one behind the other in their direction of relative movement and positioned so that the separate grooves combine to form a composite groove.

9. The improvement according to claim 1 wherein the support means comprises a roller arranged to rotate and provide support at that part of the workpiece whch is engaged by the cutter whereby the workpiece is held against the cutting edge of the cutter.

10. The improvement according to claim 1 wherein the cutter means includes at least two cutters held by the holding means one behind the other in the direction of movement of the cutters relative to the workpiece whereby the groove cut by the leading cutter is altered by the groove cut by the succeeding cutter.

* * * * *